US009145530B2

(12) United States Patent
Bera et al.

(10) Patent No.: US 9,145,530 B2
(45) Date of Patent: Sep. 29, 2015

(54) LUBRICATING OIL COMPOSITIONS CONTAINING STERICALLY HINDERED AMINES AS ASHLESS TBN SOURCES

(71) Applicants: Tushar K. Bera, Franklin Park, NJ (US); Joseph P. Hartley, Oxford (GB); Guifeng Li, Clark, NJ (US); Gabriele Candido, Didcot (GB); Christina E. Gulacsy, Sarasota, FL (US)

(72) Inventors: Tushar K. Bera, Franklin Park, NJ (US); Joseph P. Hartley, Oxford (GB); Guifeng Li, Clark, NJ (US); Gabriele Candido, Didcot (GB); Christina E. Gulacsy, Sarasota, FL (US)

(73) Assignee: INFINEUM INTERNATIONAL LIMITED (GB)

( * ) Notice: Subject to any disclaimer, the term of this patent is extended or adjusted under 35 U.S.C. 154(b) by 261 days.

(21) Appl. No.: 13/709,286

(22) Filed: Dec. 10, 2012

(65) Prior Publication Data

US 2014/0162923 A1 Jun. 12, 2014

(51) Int. Cl.
*C10M 133/06* (2006.01)
*C10M 133/08* (2006.01)

(52) U.S. Cl.
CPC ..... *C10M 133/06* (2013.01); *C10M 133/08* (2013.01); *C10M 2207/026* (2013.01); *C10M 2215/064* (2013.01); *C10M 2215/28* (2013.01); *C10M 2223/045* (2013.01); *C10M 2227/066* (2013.01); *C10N 2230/06* (2013.01); *C10N 2230/36* (2013.01); *C10N 2230/42* (2013.01); *C10N 2230/43* (2013.01); *C10N 2230/45* (2013.01); *C10N 2230/52* (2013.01); *C10N 2240/10* (2013.01)

(58) Field of Classification Search
USPC ..... 508/556, 373, 584
See application file for complete search history.

(56) References Cited

U.S. PATENT DOCUMENTS

| | | | | |
|---|---|---|---|---|
| 2,420,068 | A | 5/1947 | Duncan et al. | |
| 4,161,451 | A * | 7/1979 | Lowe | 508/334 |
| 4,795,583 | A | 1/1989 | Papay | |
| 5,525,247 | A | 6/1996 | Miyaji et al. | |
| 5,672,570 | A | 9/1997 | Miyaji et al. | |
| 6,569,818 | B2 | 5/2003 | Nakazato et al. | |
| 2007/0142251 | A1 * | 6/2007 | Fellows et al. | 508/542 |
| 2011/0224114 | A1 | 9/2011 | Emert et al. | |

FOREIGN PATENT DOCUMENTS

| | | | |
|---|---|---|---|
| EP | 2687583 | A1 | 1/2014 |
| JP | 2000034489 | A | 2/2000 |
| JP | 2001172660 | A | 6/2001 |

* cited by examiner

*Primary Examiner* — James Goloboy

(57) ABSTRACT

Hindered amines useful as ashless TBN sources for lubricating oil compositions that are compatible with fluoroelastomeric engine seal materials, and lubricating oil compositions containing such compounds.

16 Claims, No Drawings

LUBRICATING OIL COMPOSITIONS CONTAINING STERICALLY HINDERED AMINES AS ASHLESS TBN SOURCES

FIELD OF THE INVENTION

This invention relates to a novel class of sterically hindered amines useful as ashless TBN (Total Base Number) boosters lubricating oil compositions, particularly crankcase lubricating oil compositions having reduced levels of sulfated ash (SASH), containing sterically hindered amine ashless TBN (Total Base Number) boosters.

BACKGROUND OF THE INVENTION

Environmental concerns have led to continued efforts to reduce the CO, hydrocarbon and nitrogen oxide ($NO_x$) emissions of compression ignited (diesel-fueled) and spark ignited (gasoline-fueled) light duty internal combustion engines. Further, there have been continued efforts to reduce the particulate emissions of compression ignited internal combustion engines. To meet the upcoming emission standards for heavy duty diesel vehicles, original equipment manufacturers (OEMs) will rely on the use of additional exhaust gas after-treatment devices. Such exhaust gas after-treatment devices may include catalytic converters, which can contain one or more oxidation catalysts, $NO_x$ storage catalysts, and/or $NH_3$ reduction catalysts; and/or a particulate trap.

Oxidation catalysts can become poisoned and rendered less effective by exposure to certain elements/compounds present in engine exhaust gasses, particularly by exposure to phosphorus and phosphorus compounds introduced into the exhaust gas by the degradation of phosphorus-containing lubricating oil additives. Reduction catalysts are sensitive to sulfur and sulfur compounds in the engine exhaust gas introduced by the degradation of both the base oil used to blend the lubricant, and sulfur-containing lubricating oil additives. Particulate traps can become blocked by metallic ash, which is a product of degraded metal-containing lubricating oil additives.

To insure a long service life, lubricating oil additives that exert a minimum negative impact on such after-treatment devices must be identified, and OEM specifications for "new service fill" and "first fill" heavy duty diesel (HDD) lubricants require maximum sulfur levels of 0.4 mass %; maximum phosphorus levels of 0.12 mass %, and sulfated ash contents below 1.1 mass %, which lubricants are referred to as "mid-SAPS" lubricants (where "SAPS" is an acronym for "Sulfated Ash, Phosphorus, Sulfur"). In the future, OEMs may further restrict these levels maximum levels to 0.08 mass % phosphorus, 0.2 mass % sulfur and 0.8 mass % sulfated ash, with such lubricants being referred to as "low-SAPS" lubricating oil compositions.

As the amounts of phosphorus, sulfur and ash-containing lubricant additives are being reduced to provide mid- and low-SAPS lubricants that are compatible with exhaust gas after-treatment devices, the lubricating oil composition must continue to provide the high levels of lubricant performance, including adequate detergency, dictated by the "new service", and "first fill" specifications of the OEM's, such as the ACEA E6 and MB p228.51 (European) and API CI-4+ and API CJ-4 (U.S.) specifications for heavy duty engine lubricants. Criteria for being classified as a lubricating oil composition meeting the above listed industry standards is known to those skilled in the art.

The ability of a lubricant to neutralized acidic byproducts of combustion, which increases in engines provided with exhaust gas recirculation (EGR) systems, particularly condensed EGR systems in which exhaust gasses are cooled prior to recirculation, can be improved, and the drain interval of the lubricant can be extended, by increasing the total base number (TBN) of the composition. Historically, TBN has been provided by overbased detergents that introduce sulfated ash into the composition. It would be advantageous to provide a lubricating oil composition with a high level of TBN using a TBN boosting component that does not contribute sulfated ash. As highly basic components are known to induce corrosion and, in some cases reduce the compatibility between lubricating oil compositions and the fluoroelastomeric seal materials used in engines, it would be preferable to provide such a component that does not induce corrosion and, preferably, does not adversely affect seals compatibility. Due to demands for improved fuel economy, less viscous lubricants, such as 0W and 5W 20 and 30 grade lubricants have become more prevalent. To allow for easier formulation of such lubricants, the amount of polymer introduced by additives is preferably minimized. Therefore, it would be further preferable to provide a non-polymeric ashless TBN source.

U.S. Pat. Nos. 5,525,247; 5,672,570; and 6,569,818 are directed to "low ash" lubricating oil compositions in which sulfated ash content is reduced by replacing overbased detergents with neutral detergents. These patents describe such lubricants as providing sufficient detergency, but make no claim that such lubricants will provide sufficient TBN for use, for example, in HDD engines. US Patent Application 2007/0203031 describes the use of a high TBN nitrogen-containing dispersants as ashless TBN sources.

SUMMARY OF THE INVENTION

In accordance with a first aspect of the invention, there are provided lubricating oil compositions, preferably crankcase lubricating oil compositions for heavy duty diesel (HDD) engines, containing one or more hindered amines useful as additives for increasing the TBN of lubricating oil compositions without introducing sulfated ash.

In accordance with a second aspect of the invention, there are provided lubricating oil compositions, as in the first aspect, having a TBN of from about 6 to about 15 and a sulfated ash (SASH) content of less than 1.1 mass %, preferably less than 0.8 mass %.

In accordance with a third aspect of the invention, there are provided lubricating oil compositions, as in the first and second aspects, meeting the performance criteria of one or more of the ACEA E6, MB p228.51, API CI-4+ and API CJ-4 specifications for heavy duty engine lubricants.

In accordance with a fourth aspect of the invention, there is provided a heavy duty diesel engine equipped with an exhaust gas recirculation (EGR) system, preferably a condensed EGR system and a particulate trap, the crankcase of which engine is lubricated with a lubricating oil composition of the first, second or third aspect.

In accordance with a fifth aspect of the invention, there is provided a method for forming a high TBN lubricant having a reduced SASH content comprising incorporating into said lubricating oil composition one or more hindered amines useful as additives for increasing the TBN of lubricating oil compositions without introducing sulfated ash.

In accordance with a sixth aspect of the invention, there is provided a use of one or more hindered amines as an ashless lubricating oil composition TBN source.

DETAILED DESCRIPTION OF THE INVENTION

Hindered amines in accordance with the present invention, useful as ashless TBN sources for lubricating oil compositions are defined by Formula (I):

(I)

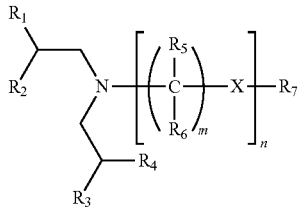

wherein $R_1$, $R_2$, $R_3$ and $R_4$ are each independently an alkyl or aryl group having 1 to about 12 carbon atoms; $R_5$ and $R_6$ are each independently H or an alkyl group having 1 to about 12 carbon atoms; X is O or $N(CH_2CHR_8R_9)$, where $R_8$ and $R_9$ are independently alkyl groups having 1 to about 12 carbon atoms; m is 2 to 6; n is 0 to 20; and $R_7$ is $(CR_5R_6)_nN(CH_2CHR_8R_9)_2$, H or an alkyl group having 1 to about 12 carbon atoms, with the proviso that, when X is $N(CH_2CHR_8R_9)$, $R_7$ is $(CR_5R_6)_nN(CH_2CHR_8R_9)_2$.

Preferred hindered amines are compounds of Formula (I) wherein $R_5$ and $R_6$ are H, $R_1$-$R_4$, $R_8$ and $R_9$ are each alkyl groups, more preferably alkyl groups having 1 to about 6 carbon atoms, X is O, m is 2 to 4, more preferably 2 or 3, most preferably 2, and n is 1 to about 3. Preferably, the hindered amine compounds of Formula (I) have a molecular weight of at least about 150 daltons, such as at least about 175 daltons, more preferably at least about 185 daltons, per N.

Hindered amines suitable for use in the lubricating oil compositions of the present invention preferably have a TBN (neat) of at least about 50 mg KOH/g, such as at least about 70 mg KOH/g, more preferably at least about 100 mg KOH/g, as measured in accordance with ASTM D-4739. Hindered amines suitable for use in the lubricating oil compositions of the present invention preferably have a TBN (neat) of no greater than about 300 mg KOH/g, such as no greater than about 250 mg KOH/g, more preferably no greater than about 200 mg KOH/g, as measured in accordance with ASTM D-4739.

Lubricating oil compositions of the present invention comprise a major amount of oil of lubricating viscosity and a minor amount of an amine of Formula I.

Oils of lubricating viscosity useful in the context of the present invention may be selected from natural lubricating oils, synthetic lubricating oils and mixtures thereof. The lubricating oil may range in viscosity from light distillate mineral oils to heavy lubricating oils such as gasoline engine oils, mineral lubricating oils and heavy duty diesel oils. Generally, the viscosity of the oil ranges from about 2 centistokes to about 40 centistokes, especially from about 4 centistokes to about 20 centistokes, as measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof. Also useful are synthetic oils derived from a gas to liquid process from Fischer-Tropsch synthesized hydrocarbons, which are commonly referred to as gas to liquid, or "GTL" base oils.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 daltons or diphenyl ether of poly-ethylene glycol having a molecular weight of 1000 to 1500 daltons); and mono- and polycarboxylic esters thereof, for example, the acetic acid esters, mixed $C_3$-$C_8$ fatty acid esters and $C_{13}$ oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl) silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl) siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II or Group III, base stock or base oil blends of the aforementioned base stocks. Preferably, the oil of lubricating viscosity is a Group II or Group III base stock, or a mixture thereof, or a mixture of a Group I base stock and one or more a Group II and Group III. Preferably, a major amount of the oil of lubricating viscosity is a Group II, Group III, Group IV or Group V base stock, or a mixture thereof. The base stock, or base stock blend preferably has a saturate content of at least 65%, more preferably at least 75%, such as at least 85%. Most preferably, the base stock, or base stock blend, has a saturate content of greater than 90%. Preferably, the oil or oil blend will have a sulfur content of less than 1%, preferably less than 0.6%, more preferably less than 0.4%, by weight.

Preferably the volatility of the oil or oil blend, as measured by the Noack volatility test (ASTM D5880), is less than or equal to 30%, preferably less than or equal to 25%, more preferably less than or equal to 20%, most preferably less than or equal 16%. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.
b) Group II base stocks contain greater than or equal to 90 percent saturates and less than or equal to 0.03 percent sulfur and have a viscosity index greater than or equal to 80 and less than 120 using the test methods specified in Table 1.
c) Group III base stocks contain greater than or equal to 90 percent saturates and less than or equal to 0.03 percent sulfur and have a viscosity index greater than or equal to 120 using the test methods specified in Table 1.
d) Group IV base stocks are polyalphaolefins (PAO).
e) Group V base stocks include all other base stocks not included in Group I, II, III, or IV.

TABLE I

Analytical Methods for Base Stock

| Property | Test Method |
|---|---|
| Saturates | ASTM D 2007 |
| Viscosity Index | ASTM D 2270 |
| Sulfur | ASTM D 2622 |
| | ASTM D 4294 |
| | ASTM D 4927 |
| | ASTM D 3120 |

Metal-containing or ash-forming detergents function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number or TBN (as can be measured by ASTM D2896) of from 0 to 80. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents may have a TBN of 150 or greater, and typically will have a TBN of from 250 to 450 or more. In the presence of the compounds of Formula I, the amount of overbased detergent can be reduced, or detergents having reduced levels of overbasing (e.g., detergents having a TBN of 100 to 200), or neutral detergents can be employed, resulting in a corresponding reduction in the SASH content of the lubricating oil composition without a reduction in the performance thereof.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., sodium, potassium, lithium, calcium, and magnesium. The most commonly used metals are calcium and magnesium, which may both be present in detergents used in a lubricant, and mixtures of calcium and/or magnesium with sodium. Particularly convenient metal detergents are neutral and overbased calcium sulfonates having TBN of from 20 to 450 TBN, and neutral and overbased calcium phenates and sulfurized phenates having TBN of from 50 to 450. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that that is stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Lubricating oil compositions of the present invention may further contain one or more ashless dispersants, which effectively reduce formation of deposits upon use in gasoline and diesel engines, when added to lubricating oils. Ashless dispersants useful in the compositions of the present invention comprises an oil soluble polymeric long chain backbone having functional groups capable of associating with particles to be dispersed. Typically, such dispersants comprise amine, alcohol, amide or ester polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine. The most common dispersant in use is the succinimide dispersant, which is a condensation product of a hydrocarbyl-substituted succinic anhydride and a poly(alkyleneamine). Both mono- and bis-succinimide dispersants (and mixtures thereof) are well known.

Preferably, the ashless dispersant is a "high molecular weight" dispersant having a number average molecular weight (Ma) greater than or equal to 4,000 daltons, such as between 4,000 and 20,000 daltons. The precise molecular weight ranges will depend on the type of polymer used to form the dispersant, the number of functional groups present, and the type of polar functional group employed. For example, for a polyisobutylene derivatized dispersant, a high molecular weight dispersant is one formed with a polymer backbone having a number average molecular weight of from about 1680 daltons to about 5600 daltons. Typical commercially available polyisobutylene-based dispersants contain polyisobutylene polymers having a number average molecular weight ranging from about 900 to about 2300 daltons, functionalized by maleic anhydride (MW=98), and derivatized with polyamines having a molecular weight of from about 100 to about 350 daltons. Polymers of lower molecular weight may also be used to form high molecular weight dispersants by incorporating multiple polymer chains into the dispersant, which can be accomplished using methods that are known in the art.

Preferred groups of dispersant include polyamine-derivatized poly α-olefin, dispersants, particularly ethylene/butene alpha-olefin and polyisobutylene-based dispersants. Particularly preferred are ashless dispersants derived from polyisobutylene substituted with succinic anhydride groups and reacted with polyethylene amines, e.g., polyethylene diamine, tetraethylene pentamine; or a polyoxyalkylene polyamine, e.g., polyoxypropylene diamine, trimethylolaminomethane; a hydroxy compound, e.g., pentaerythritol; and combinations thereof. One particularly preferred dispersant combination is a combination of (A) polyisobutylene substituted with succinic anhydride groups and reacted with (B) a hydroxy compound, e.g., pentaerythritol; (C) a polyoxyalkylene polyamine, e.g., polyoxypropylene diamine, or (D) a polyalkylene diamine, e.g., polyethylene diamine and tetraethylene pentamine using about 0.3 to about 2 moles of (B), (C) and/or (D) per mole of (A). Another preferred dispersant combination comprises a combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane, as described in U.S. Pat. No. 3,632,511.

Another class of ashless dispersants comprises Mannich base condensation products. Generally, these products are prepared by condensing about one mole of an alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant can be further post treated by a variety of conventional post treatments such as boration, as generally taught in U.S. Pat. Nos. 3,087,936 and 3,254,025. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition. Useful dispersants contain from about 0.05 to about 2.0 mass %, e.g., from about 0.05 to about 0.7 mass % boron. The boron, which appears in the product as dehydrated boric acid polymers (primarily $(HBO_2)_3$), is believed to attach to the dispersant imides and diimides as amine salts, e.g., the metaborate salt of the diimide. Boration can be carried out by adding from about 0.5 to 4 mass %, e.g., from about 1 to about 3 mass % (based on the mass of acyl nitrogen compound) of a boron compound, preferably boric acid, usually as a slurry, to the acyl nitrogen compound and heating with stirring at from about 135° C. to about 190° C., e.g., 140° C. to 170° C., for from about 1 to about 5 hours, followed by nitrogen stripping. Alternatively, the boron treatment can be conducted by adding boric acid to a hot reaction mixture of the dicarboxylic acid material and amine, while removing water. Other post reaction processes commonly known in the art can also be applied.

The dispersant may also be further post treated by reaction with a so-called "capping agent". Conventionally, nitrogen-containing dispersants have been "capped" to reduce the adverse effect such dispersants have on the fluoroelastomer engine seals. Numerous capping agents and methods are known. Of the known "capping agents", those that convert basic dispersant amino groups to non-basic moieties (e.g., amido or imido groups) are most suitable. The reaction of a nitrogen-containing dispersant and alkyl acetoacetate (e.g., ethyl acetoacetate (EAA)) is described, for example, in U.S. Pat. Nos. 4,839,071; 4,839,072 and 4,579,675. The reaction of a nitrogen-containing dispersant and formic acid is described, for example, in U.S. Pat. No. 3,185,704. The reaction product of a nitrogen-containing dispersant and other suitable capping agents are described in U.S. Pat. No. 4,663,064 (glycolic acid); U.S. Pat. Nos. 4,612,132; 5,334,321; 5,356,552; 5,716,912; 5,849,676; 5,861,363 (alkyl and alkylene carbonates, e.g., ethylene carbonate); U.S. Pat. No. 5,328,622 (mono-epoxide); U.S. Pat. Nos. 5,026,495; 5,085,788; 5,259,906; 5,407,591 (poly (e.g., bis)-epoxides) and U.S. Pat. No. 4,686,054 (maleic anhydride or succinic anhydride). The foregoing list is not exhaustive; other methods of capping nitrogen-containing dispersants are known to those skilled in the art.

For adequate piston deposit control, a nitrogen-containing dispersant can be added in an amount providing the lubricating oil composition with from about 0.03 mass % to about 0.15 mass %, preferably about 0.07 to about 0.12 mass %, nitrogen.

Ashless dispersants are basic in nature and therefore have a TBN which, depending on the nature of the polar group and whether or not the dispersant is borated or treated with a capping agent, may be from about 5 to about 200 mg KOH/g. However, high levels of basic dispersant nitrogen are known to have a deleterious effect on the fluoroelastomeric materials conventionally used to form engine seals and, therefore, it is preferable to use the minimum amount of dispersant necessary to provide piston deposit control, and to use substantially no dispersant, or preferably no dispersant, having a TBN of greater than 5. Preferably, the amount of dispersant employed will contribute no more than 4, preferably no more than 3 mg KOH/g of TBN to the lubricating oil composition. It is further preferable that dispersant provides no greater than 30, preferably no greater than 25% of the TBN of the lubricating oil composition.

Additional additives may be incorporated in the compositions of the invention to enable them to meet particular requirements. Examples of additives which may be included in the lubricating oil compositions are metal rust inhibitors, viscosity index improvers, corrosion inhibitors, oxidation inhibitors, friction modifiers, other dispersants, anti-foaming agents, anti-wear agents and pour point depressants. Some are discussed in further detail below.

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 wt. %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the formula:

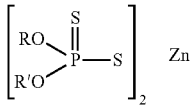

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate can therefore comprise zinc dialkyl dithiophosphates. The present invention may be particularly useful when used with lubricant compositions containing phosphorus levels of from about 0.02 to about 0.12 mass %, such as from about 0.03 to about 0.10 mass %, or from about 0.05 to about 0.08 mass %, based on the total mass of the composition. In one preferred embodiment, lubricating oil compositions of the present invention contain zinc dialkyl dithiophosphate derived predominantly (e.g., over 50 mol. %, such as over 60 mol. %) from secondary alcohols.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons, phosphorous esters, metal thiocarbamates, oil soluble copper compounds as described in U.S. Pat. No. 4,867,890, and molybdenum-containing compounds.

Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups.

Multiple antioxidants are commonly employed in combination. In one preferred embodiment, lubricating oil compositions of the present invention contain from about 0.1 to about 1.2 mass % of aminic antioxidant and from about 0.1 to about 3 mass % of phenolic antioxidant. In another preferred embodiment, lubricating oil compositions of the present invention contain from about 0.1 to about 1.2 mass % of aminic antioxidant, from about 0.1 to about 3 mass % of phenolic antioxidant and a molybdenum compound in an amount providing the lubricating oil composition from about 10 to about 1000 ppm of molybdenum.

Representative examples of suitable viscosity modifiers are polyisobutylene, copolymers of ethylene and propylene, polymethacrylates, methacrylate copolymers, copolymers of an unsaturated dicarboxylic acid and a vinyl compound, interpolymers of styrene and acrylic esters, and partially hydrogenated copolymers of styrene/isoprene, styrene/butadiene, and isoprene/butadiene, as well as the partially hydrogenated homopolymers of butadiene and isoprene.

Friction modifiers and fuel economy agents that are compatible with the other ingredients of the final oil may also be included. Examples of such materials include glyceryl monoesters of higher fatty acids, for example, glyceryl monooleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formulae:

$Mo(ROCS_2)_4$ and $Mo(RSCS_2)_4$ wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35 carbon atoms.

A dispersant-viscosity index improver functions as both a viscosity index improver and as a dispersant. Examples of dispersant-viscosity index improvers include reaction products of amines, for example polyamines, with a hydrocarbyl-substituted mono- or di-carboxylic acid in which the hydrocarbyl substituent comprises a chain of sufficient length to impart viscosity index improving properties to the compounds. In general, the viscosity index improver dispersant may be, for example, a polymer of a $C_4$ to $C_{24}$ unsaturated ester of vinyl alcohol or a $C_3$ to $C_{10}$ unsaturated mono-carboxylic acid or a $C_4$ to $C_{10}$ di-carboxylic acid with an unsaturated nitrogen-containing monomer having 4 to 20 carbon atoms; a polymer of a $C_2$ to $C_{20}$ olefin with an unsaturated $C_3$ to $C_{10}$ mono- or di-carboxylic acid neutralized with an amine, hydroxylamine or an alcohol; or a polymer of ethylene with a $C_3$ to $C_{20}$ olefin further reacted either by grafting a $C_4$ to $C_{20}$ unsaturated nitrogen-containing monomer thereon or by grafting an unsaturated acid onto the polymer backbone and then reacting carboxylic acid groups of the grafted acid with an amine, hydroxy amine or alcohol.

Pour point depressants, otherwise known as lube oil flow improvers (LOFI), lower the minimum temperature at which the fluid will flow or can be poured. Such additives are well known. Typical of those additives that improve the low temperature fluidity of the fluid are $C_8$ to $C_{18}$ dialkyl fumarate/vinyl acetate copolymers, and polymethacrylates. Foam control can be provided by an antifoamant of the polysiloxane type, for example, silicone oil or polydimethyl siloxane.

Some of the above-mentioned additives can provide a multiplicity of effects; thus for example, a single additive may act as a dispersant-oxidation inhibitor. This approach is well known and need not be further elaborated herein.

In the present invention it may also be preferable to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed.

When lubricating compositions contain one or more of the above-mentioned additives, each additive is typically blended into the base oil in an amount that enables the additive to provide its desired function.

When lubricating compositions contain one or more of the above-mentioned additives, each additive is typically blended into the base oil in an amount that enables the additive to provide its desired function. Representative effect amounts of such additives, when used in crankcase lubricants, are listed below. All the values listed are stated as mass percent active ingredient.

TABLE II

| ADDITIVE | MASS % (Broad) | MASS % (Preferred) |
|---|---|---|
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-3 |
| Pour Point Depressant | 0.01-5 | 0.01-1.5 |
| Antifoaming Agent | 0-5 | 0.001-0.15 |
| Supplemental Antiwear Agents | 0-1.0 | 0-0.5 |
| Friction Modifier | 0-5 | 0-1.5 |
| Viscosity Modifier | 0.01-10 | 0.25-3 |
| Basestock | Balance | Balance |

Fully formulated lubricating oil compositions of the present invention preferably have a TBN of at least 6 mg KOH/g, such as from about 6 to about 18 mg KOH/g (ASTM D2896). More preferably, compositions of the present invention have a TBN of at least 8.5 mg KOH/g, such as from about 8.5 or 9 to about 18 mg KOH/g.

Fully formulated lubricating oil compositions of the present invention preferably have a sulfated ash (SASH) content (ASTM D-874) of about 1.1 mass % or less, preferably about 1.0 mass % or less, more preferably about 0.8 mass % or less, such as 0.5 mass % or less.

Preferably, fully formulated lubricating oil compositions of the present invention derive at least 5%, preferably at least 10%, more preferably at least 20% of the compositional TBN (as measured in accordance with ASTM D4739) from ashless TBN sources including at least one amine of Formula I. More preferably, fully formulated lubricating oil compositions of the present invention derive at least 5%, preferably at least 10%, more preferably at least 20% of the compositional TBN from at least one amine of Formula I. Preferably, fully formulated lubricating oil compositions of the present invention contains an amount of an amine of Formula I that contributes from about 0.5 to about 4 mg KOH/g, preferably from about 1 to about 3 mg KOH/g of TBN (ASTM D4739) to the composition.

Fully formulated lubricating oil compositions of the present invention further preferably have a sulfur content of less than about 0.4 mass %, more less than about 0.35 mass % more preferably less than about 0.03 mass %, such as less than about 0.20 mass %. Preferably, the Noack volatility (ASTM D5880) of the fully formulated lubricating oil composition (oil of lubricating viscosity plus all additives and additive diluent) will be no greater than 13, such as no greater than 12, preferably no greater than 10. Fully formulated lubricating oil compositions of the present invention preferably have no greater than 1200 ppm of phosphorus, such as no greater than 1000 ppm of phosphorus, or no greater than 800 ppm of phosphorus, such as no greater than 600 ppm of phosphorus, or no greater than 500 or 400 ppm of phosphorus.

It may be desirable, although not essential to prepare one or more additive concentrates comprising additives (concentrates sometimes being referred to as additive packages) whereby several additives can be added simultaneously to the oil to form the lubricating oil composition. A concentration for the preparation of a lubricating oil composition of the present invention may, for example, contain from about 5 to about 30 mass % of one or more compounds of Formula (I); about 10 to about 40 mass % of a nitrogen-containing dispersant; about 2 to about 20 mass % of an aminic antioxidant, a phenolic antioxidant, a molybdenum compound, or a mixture thereof; about 5 to 40 mass % of a detergent; and from about 2 to about 20 mass % of a metal dihydrocarbyl dithiophosphate.

The final composition may employ from 5 to 25 mass %, preferably 5 to 18 mass %, typically 10 to 15 mass % of the concentrate, the remainder being oil of lubricating viscosity and viscosity modifier.

All weight (and mass) percents expressed herein (unless otherwise indicated) are based on active ingredient (A.I.) content of the additive, and/or additive-package, exclusive of any associated diluent. However, detergents are conventionally formed in diluent oil, which is not removed from the product, and the TBN of a detergent is conventionally provided for the active detergent in the associated diluent oil. Therefore, weight (and mass) percentages, when referring to detergents are (unless otherwise indicated) total weight (or mass) percent of active ingredient and associated diluent oil.

This invention will be further understood by reference to the following examples, wherein all parts are parts by weight (or mass), unless otherwise noted.

SYNTHESIS EXAMPLES

Amine 1: Linear Amine—Tri-n-pentylamine (Comparative)

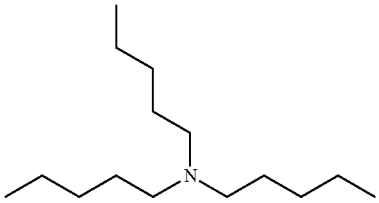

Commercially available material; available from Tokyo Chemical Industry, Tokyo, Japan and TCI America, Portland Oreg., USA at 98% purity.

Amine 2: Linear Amine—Tri-n-octylamine (Comparative)

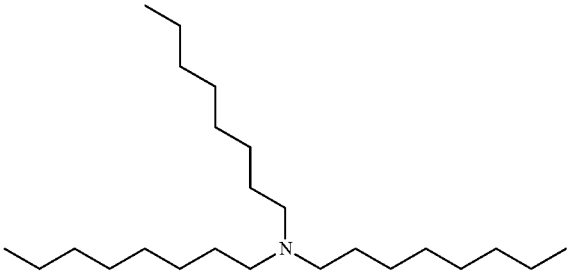

Commercially available material; available from Alfa Aesar, a Johnson Matthey Company, Ward Hill, Mass., USA at 95% purity.

Synthesis Example 1

Amine 3: N,N-bis(2-ethylhexyl)dodecan-1-amine (Comparative)

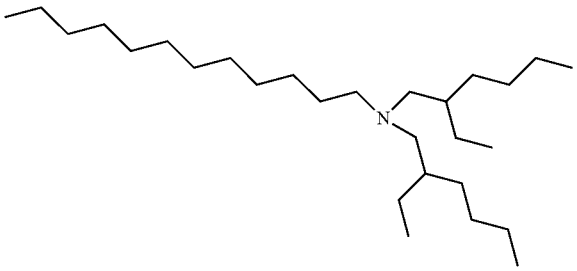

A 1 L metal reactor was charged with dodecan-1-amine (50 g, 270 mmol), 2-ethylhexanal (78 g, 582 mmol), Palladium on carbon (3 g, 1% of the amine), and ethanol (500 mL). While stirring at 600 rpm, the flow of hydrogen was set to 5.0 bars at room temperature (hydrogen was charged four times; a total of 16.8 bars of hydrogen were consumed by the reaction). The solution was then filtered over Celite and concentrated. The reaction yielded 102 g of yellow oil containing mono- and di-alkylated product. The di-alkylated product was purified and isolated by column chromatography [heptane/ethyl acetate 99.8/0.2], which resulted in a pale yellow oil (47 g, 43.4% yield). GC-MS confirmed the product purity to be 100.00%. $^1$H NMR (300 MHz, $CDCl_3$) δ 0.86 (m, 15H), 1.26 (m, 38H), 2.08 (d, 4H), 2.26 (t, 2H).

Synthesis Example 2

Amine 4: 2-Ethyl-N-(2-ethylhexyl)-N-(2-methoxyethyl)hexan-1-amine (Inventive)

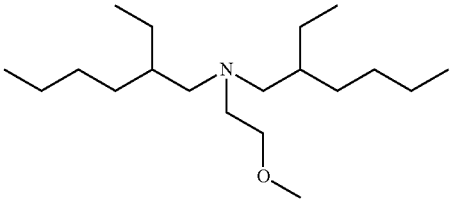

2-Methoxyethanamine (10 g, 133 mmol), 2-ethylhexanal (37.6 g, 293 mmol) and dichloromethane (DCM, 40 g) were stirred at room temperature in a 250 mL 4-neck round bottom flask equipped with a reflux condenser, thermocouple, overhead stirrer and nitrogen blanket. The mixture was left to stir 3 hours. Sodium triacetoxyborohydride (STAB, 62.1 g, 293 mmol) was slowly added portion-wise to the flask. $^1$H NMR showed the reaction reached completion and was quenched with saturated aqueous sodium bicarbonate solution. The organic layer was washed with saturated aqueous sodium bicarbonate and brine. This layer was then dried over magnesium sulphate, filtered, and concentrated yielding a cloudy orange oil. Product was purified by column chromatography

[heptane/ethyl acetate 95/5] resulting in a colourless oil (30.4 g, 76% yield). GC-MS confirmed the product purity to be 97%. $^1$H NMR (300 MHz, $CDCl_3$) δ 0.81-0.91 (m, 12H), 1.20-1.38 (m, 18H), 2.18 (d, 4H), 2.54 (t, 2H), 3.33 (s, 3H), 3.41 (t, 2H).

Synthesis Example 3

Amine 5: N,N'-(2,2'-(Ethane-1,2-diylbis(oxy))bis(ethane-2,1-diyl))bis(2-ethyl-N-(2-ethylhexyl)hexan-1-amine) (Inventive)

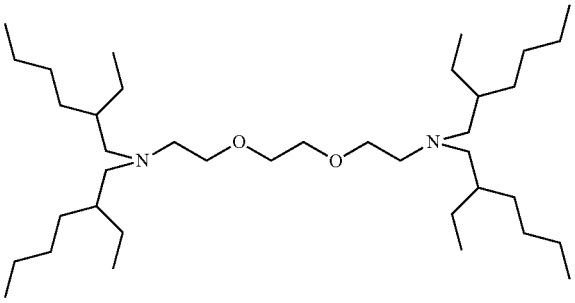

2,2'-(Ethane-1,2-diylbis(oxy))diethanamine (12.5 g, 84 mmol), 2-ethylhexanal (47.6 g, 371 mmol), and DCM (50 g) were stirred at room temperature in a 250 mL 4-neck round bottom flask equipped with a reflux condenser, thermocouple, overhead stirrer, and nitrogen blanket. The mixture was left to stir 12 hours. STAB (86 g, 405 mmol) was slowly added portion-wise to the flask. $^1$H NMR showed the reaction reached completion and was quenched with saturated aqueous sodium bicarbonate solution. The organic layer was washed with saturated aqueous sodium bicarbonate and brine. This layer was then dried over magnesium sulphate, filtered, and concentrated yielding a pale yellow oil. Product was purified by column chromatography [heptane/ethyl acetate 80/20] (63.7 g, 63% yield) resulting in a clear oil. GC-MS confirmed the product purity to be 99%. NMR (300 MHz, $CDCl_3$) δ 0.81-0.91 (m, 24H), 1.22-1.36 (m, 36H), 2.17 (d, 8H), 2.56 (m, 4H), 3.49 (t, 4H), 3.57 (s, 4H).

Synthesis Example 4

Amine 6: N,N'-(3,3'-(2,2'-Oxybis(ethane-2,1-diyl)bis(oxy)bis(propane-3,1-diyl)bis(2-ethyl-N-(2-ethylhexyl)hexan-1-amine) (Comparative)

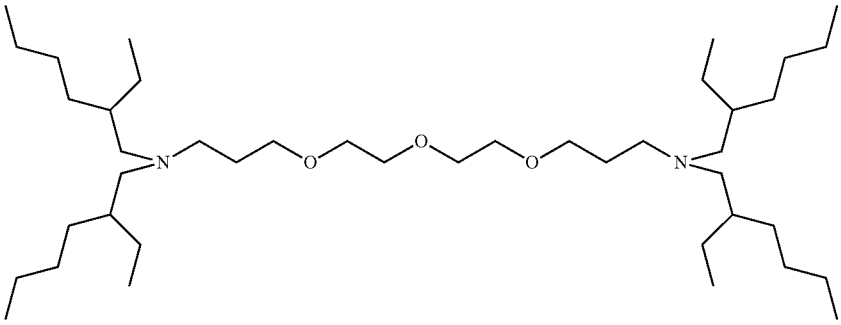

3,3'-(2,2'-Oxybis(ethane-2,1-diyl)bis(oxy))dipropan-1-amine (12.5 g, 56.7 mmol), 2-ethylhexanal (32.0 g, 250 mmol) and DCM (50 g) were stirred at room temperature in a 250 mL 4-neck round bottom flask equipped with a reflux condenser, thermocouple, overhead stirrer and nitrogen blanket. The mixture was left to stir 12 hours. STAB (57.7 g, 272 mmol) was slowly added portion-wise to the flask. $^1$H NMR showed the reaction reached completion and was quenched with saturated aqueous sodium bicarbonate solution. The organic layer was washed with saturated aqueous sodium bicarbonate and brine. This layer was then dried over magnesium sulphate, filtered, and concentrated yielding an orange oil. Product was purified by column chromatography [heptane/ethyl acetate 75/25] (29.71 g, 77% yield) resulting in a yellow oil. GC-MS confirmed the product purity to be 97%. $^1$H NMR (300 MHz, $CDCl_3$) δ 0.81-0.91 (m, 24H), 1.19-1.36 (m, 36H), 1.68 (quin, 4H), 2.09 (d, 8H), 2.35 (t, 4H), 3.48 (t, 4H), 3.55-3.66 (m, 8H).

Synthesis Example 5

Amine 7: N-(3-(Butoxypropyl)-2-ethyl-N-(2-ethylhexyl)hexan-1-amine (Comparative)

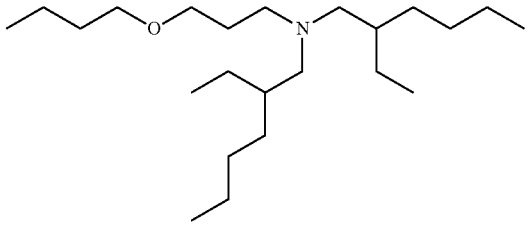

3-Butoxypropan-1-amine (12.0 g, 91 mmol) and 2-ethylhexanal (25.8 g, 201 mmol) were stirred at room temperature in a 250 mL 4-neck round bottom flask equipped with a reflux condenser, thermocouple, overhead stirrer and nitrogen blanket. The mixture was left to stir 3 hours, STAB (42.6 g, 201 mmol) was slowly added portion-wise to the flask. DCM (22 g) was added following completed addition of STAB. $^1$H NMR showed the reaction reached completion and was quenched with saturated aqueous sodium bicarbonate solution. The organic layer was washed with saturated aqueous sodium bicarbonate and brine. This layer was then dried over magnesium sulphate, filtered, and concentrated yielding a red oil. Product was purified by column chromatography [heptane/ethyl acetate 90/10] (27.3 g, 84% yield) resulting in a yellow oil. GC-MS confirmed the product purity to be 99%. $^1$H NMR (300 MHz, $CDCl_3$) δ 0.81-0.94 (m, 15H), 1.20-1.43 (m, 20H), 1.50-1.60 (m, 2H), 1.61-1.70 (m, 2H), 2.10 (d, 4H), 2.36 (t, 4H), 3.37-3.45 (m, 4H).

Synthesis Example 6

Amine 8: N,N'-((ethane-1,2-diylbis(oxy))bis(ethane-2,1-diyl))bis(2-ethyl-N-(4-methylpentan-2-yl)hexan-1-amine) (Comparative)

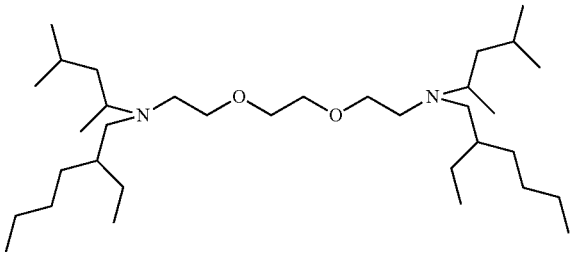

Step 1: N,N'-((ethane-1,2-diylbis(oxy))bis(ethane-2,1-diyl))bis(4-methylpentan-2-amine)

A 1 liter 3 necked round bottomed flask fitted with condenser, mechanical stirrer, dropping funnel, thermocouple and nitrogen inlet at <20 mL/min was charged with 20 g (0.1350 mol) of 2,2'-(ethylenedioxy)bis(ethylamine) in 450 mL of dichloromethane. STAB (31.44 g) was added with stirring. 31.0 g of 4-methyl-2-pentanone was then added drop-wise to the suspension over 40 mins. After cooling to 23° C. with an ice bath the mixture was stirred at room temperature for about 1.5 hours and left standing for a further day. The crude product was stirred with a mixture of saturated aqueous sodium carbonate solution (30%) (120 ml) and water (60 ml). The aqueous phase was diluted with water (100 ml), shaken, separated and washed with DCM (50 ml). The combined organic phase was washed with water (2×150 ml). It was then dried by shaking with magnesium sulphate and filtered.

Step 2

A 1 liter 3 necked round bottomed flask fitted with condenser, 100 mL pressure equalizing dropping funnel, nitrogen inlet, digital thermometer and mechanical stirrer with PTFE paddle was charged with the crude product from step 1 above; a N,N'-((ethane-1,2-diylbis(oxy))bis(ethane-2,1-diyl))bis(4-methylpentan-2-amine) solution in 560 mL dichloromethane. To this solution was added 40.06 g of STAB followed by 8.11 g of glacial acetic acid. 38.08 g of 2-ethylhexanal dissolved in 15 ml of DCM was then added drop-wise into the stirred mixture over ~30 mins. The mixture was then stirred at ambient temperature for 1.5 his and allowed to stand overnight. The crude product was stirred with saturated aqueous sodium carbonate solution (30%) (120 ml) and water (60 ml). 200 ml of ethyl acetate and 100 ml water were then added, the mixture shaken up and the organic layer separated. The aqueous phase washed with 100 ml ethyl acetate and the combined organic phase was then washed with water (2×100 ml). It was dried, by shaking with magnesium sulphate, filtered and evaporated under high vacuum to leave 28.5 g of a pale yellow oil (yield 28.5 g, 39% over 2 steps, GC-MS>96% purity). $^1$H NMR (300 MHz, $CDCl_3$) δ 0.57-1.73 (m, 54H); 1.99-2.27 (m, 4H); 2.29-2.47 (m, 2H); 2.48-2.78 (m, 4H); 3.23-3.59 (m, 8H).

Synthesis Example 7

Amine 9: 2-ethyl-N-(2-ethylhexyl)-N-(2-phenoxyethyl)hexan-1-amine (Comparative)

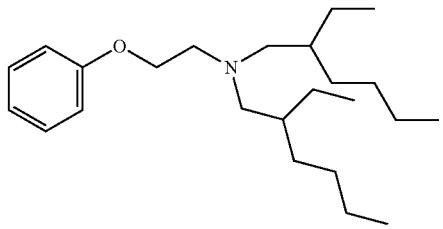

A 1 L, 3 necked round bottomed flask equipped with condenser, addition funnel and mechanical stirrer was charged with 2-phenoxyethanamine (25 g (98% purity), 179 mmol, 1 eq), STAB (94 g (97% purity), 429 mmol, 2.4 eq) and 450 mL of DCM and a magnetic stirrer. The addition funnel was charged with 2-ethyhexanal (50.4 g (99% purity), 393 mmol, 2.2 eq) and 25 mL of DCM. The reaction was left overnight without stirring. The reaction was quenched with a saturated solution $NaHCO_3$, the organic phase was partitioned and treated with again with $NaHCO_3$ and then washed with water. The organic phase was dried with $MgSO_4$, filtered and concentrated. 61.4 g (95% yield) of pale yellow oil was obtained. GC-MS analysis showed presence of the desired di-alkylated phenoxy ethylamine (>97% purity). $^1$H NMR (300 MHz, $CDCl_3$) δ 0.78-0.95 (m, 12H); 1.16-1.47 (m, 18H); 2.25 (d, 4H); 2.77 (t, 2H); 3.98 (t, 2H); 6.84-6.96 (m, 3H); 7.22-7.32 (m, 2H).

EXAMPLES

A reference composition representative of a commercial Heavy Duty Diesel (HDD) engine lubricating oil meeting the performance requirements of API CJ-4 was prepared using a commercially available Detergent/Inhibitor (DI) package (Infineum D3474, available from Infineum USA L.P., Linden N.J., USA and Infineum UK Ltd., Abingdon Oxfordshire, UK), containing a combination of detergent, antioxidant, antiwear, and friction modifying additives. To this reference oil, various amine compounds were added in amounts that increased the TBN of the reference oil 2 mg KOH/g, as measured by ASTM D4739. The resulting lubricating oil compositions were subjected to an industry standard MB AK6 Seals Test, designed to quantify the adverse effect a lubricating oil composition has on fluoroelastomeric materials commonly used to form engine seals, and which must be passed to qualify as a MB p228.51 lubricant. The results are shown in the following table:

TABLE III

| Ex. Inv./ Comp. | Amine | $R^1$ | $R^2$ | $R^3$ | Amine TBN[1] | TBN Boost[2] | MB AK6 Test Parameter (limit) TS[a] (−50) | EAB[b] (−55) | VC[c] (0 to +5) | H[d] (−5 to +5) |
|---|---|---|---|---|---|---|---|---|---|---|
| 1 (Ref.) | — | — | — | — | — | — | −40.0 | −36.0 | 0.50 | −1.0 |
| 2 (Comp.) | 1 | n | n | n | 241 | 2 | −65.7 | −81.1 | 0.82 | 9.0 |
| 3 (Comp.) | 2 | n | n | n | 157 | 2 | −71.4 | −68.7 | 3.00 | 1.2 |
| 4 (Comp.) | 3 | n | β | β | 135 | 2 | −57.0 | −55.0 | 0.90 | 0.0 |
| 5 (Inv.) | 4 | 2-alkoxy | β | β | 186 | 3 | −45.0 | −47.7 | 0.78 | 1.0 |
| 6 (Inv.) | 5 | 2-alkoxy | β | β | 183 | 2 | −49.6 | −35.5 | 0.85 | 1.0 |
| 7 (Comp.) | 6 | 3-alkoxy | β | β | 166 | 2 | −60.5 | −52.8 | 0.69 | 3.0 |
| 8 (Comp.) | 7 | 3-alkoxy | β | β | 163 | 2 | −54.2 | −60.0 | 0.70 | 0.0 |
| 9 (Comp.) | 8 | 2-alkoxy | α | β | 207 | 2 | −54.0 | −59.0 | 2.00 | 0.7 |
| 10 (Comp.) | 9 | 2-aryloxy | β | β | 155 | 2 | −54.0 | −59.0 | 2.00 | 0.7 |

[1]tTBN of the amine compound (ASTM D4739) in units of mg KOH/g
[2]increase in TBN of the lubricating oil composition (ASTM D4739) due to addition of amine (mg KOH/g)
[a]change in Tensile Strength (%)
[b]change in elongation at break (%)
[c]change in volume (%)
[d]Shore A Hardness As shown by the data of Table III, the addition of a linear alkyl amine to a lubricant as an ashless TBN source results in a failure of the MB AK-6 seal compatibility test, indicating that such lubricants would have an adverse effect on engine seals (see Examples 2 and 3). The addition of an amine having two branched groups and one linear group also results in the failure of the MB AK-6 test (see Example 4).

In contrast, as shown by Examples 5 and 6, amines of the present invention, which bear two β-branched alkyl groups and a third chain bearing an alkyl ether on the second carbon demonstrate MB AK-6 fluoro-hydrocarbon seal compatibility when used in amounts sufficient to boost the TBN of the lubricant 2 mg KOH/g (as measured according to ASTM D4739)

Examples 7 and 8 show that the use of an amine having the same two branched alkyl chains with a third chain bearing an alkyl ether on the third carbon results in the failure of the MB AK-6 seal compatibility test. Example 10 shows that the use of an amine having the same two branched alkyl chains with a third chain bearing an aryl ether on the second carbon also results in the failure of the MB AK-6 seal compatibility test.

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A lubricating oil composition comprising a major amount of oil of lubricating viscosity and a minor amount of one or more compounds of Formula (I):

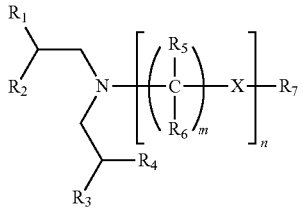

(I)

wherein $R_1$, $R_2$, $R_3$ and $R_4$ are each independently an alkyl group having 1 to about 12 carbon atoms; $R_5$ and $R_6$ are each H; X is O; m is 2 to 4; n is 1 to 3; and $R_7$ is H, an alkyl group having 1 to about 12 carbon atoms or $(CR_5R_6)_nN(CH_2CHR_8R_9)_2$ where $R_8$ and $R_9$ are independently alkyl groups having 1 to about 12 carbon atoms.

2. A lubricating oil composition, as claimed in claim 1, having a TBN of at least about 6 mg KOH/g, as measured in accordance with ASTM D-2896.

3. A lubricating oil composition, as claimed in claim 2, having a TBN of from about 6 to about 18 mg KOH/g, as measured in accordance with ASTM D-2896.

4. A lubricating oil composition, as claimed in claim 1, having a SASH content of no greater than 1.1 mass %.

5. A lubricating oil composition, as claimed in claim 4, having a SASH content of no greater than 1.0 mass %.

6. A lubricating oil composition, as claimed in claim 5, having a SASH content of no greater than 0.8 mass %.

7. A lubricating oil composition, as claimed in claim 4, wherein at least 10% of the compositional TBN, as measured in accordance with ASTM D4739, is derived from ashless TBN sources including at least one compound of Formula (I).

8. A lubricating oil composition, as claimed in claim 7, wherein at least 20% of the compositional TBN, as measured in accordance with ASTM D4739, is derived from at least one compound of Formula (I).

9. A lubricating oil composition, as claimed in claim 1, wherein from about 0.5 to about 4 mg KOH/g of the TBN of the composition, as measured in accordance with ASTM D4739, is derived from a compound of Formula (I).

10. A lubricating oil composition, as claimed in claim 4, having a sulfur content of less than about 0.4 mass, and no greater than 1200 ppm of phosphorus.

11. A lubricating oil composition, as claimed in claim 1, comprising a compound of Formula (I) wherein m is 2 or 3.

12. A lubricating oil composition, as claimed in claim 11, comprising a compound of Formula (I) wherein $R_1$-$R_4$, $R_8$ and $R_9$ are each alkyl groups having 1 to about 6 carbon atoms, and m is 2.

13. A lubricating oil composition, as claimed in claim 1, comprising a compound of Formula (I) having a TBN of at least about 50 mg KOH/g, as measured in accordance with ASTM D-4739.

14. A lubricating oil composition, as claimed in claim 13, comprising a compound of Formula (I) having a TBN of no greater than about 300 mg KOH/g, as measured in accordance with ASTM D-4739.

15. A concentrate for the preparation of a lubricating oil composition, as claimed in claim 1, said concentrate comprising from about 2.5 to about 30 mass % of one or more compounds of Formula (I); about 10 to about 40 mass % of a nitrogen-containing dispersant; about 2 to about 20 mass % of an aminic antioxidant, a phenolic antioxidant, a molybdenum compound, or a mixture thereof; about 5 to 40 mass % of a detergent; and from about 2 to about 20 mass % of a metal dihydrocarbyl dithiophosphate.

16. A method of increasing the TBN of a lubricating oil composition without concurrently increasing the SASH content, which method comprises adding to said lubricating oil composition one or more compounds of Formula (I):

(I)

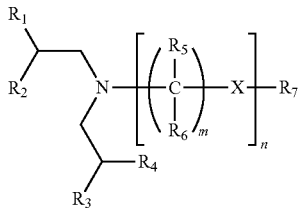

wherein $R_1$, $R_2$, $R_3$ and $R_4$ are each independently an alkyl group having 1 to about 12 carbon atoms; $R_5$ and $R_6$ are each H; X is O; m is 2 to 4; n is 1 to 3; and $R_7$ is H, an alkyl group having 1 to about 12 carbon atoms or $(CR_5R_6)_nN(CH_2CHR_8R_9)_2$ where $R_8$ and $R_9$ are independently alkyl groups having 1 to about 12 carbon atoms.

* * * * *